US006787516B2

(12) United States Patent
Moorfield et al.

(10) Patent No.: US 6,787,516 B2
(45) Date of Patent: Sep. 7, 2004

(54) FABRIC CARE COMPOSITIONS COMPRISING AN ORGANOPHILIC CLAY AND A FUNCTIONALIZED OIL

(75) Inventors: David Moorfield, Wirral (GB); Nicola Whilton, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/634,112

(22) Filed: Aug. 4, 2003

(65) Prior Publication Data

US 2004/0038853 A1 Feb. 26, 2004

Related U.S. Application Data

(63) Continuation of application No. 10/025,293, filed on Dec. 19, 2001, now Pat. No. 6,656,901.

(30) Foreign Application Priority Data

Dec. 22, 2000 (EP) ..... 00311621

(51) Int. Cl.[7] ..... C11D 3/08; C11D 3/382

(52) U.S. Cl. ..... 510/507; 510/276; 510/334; 510/437; 510/463; 510/485; 510/504; 510/515

(58) Field of Search ..... 510/276, 334, 510/437, 463, 485, 504, 507, 515

(56) References Cited

U.S. PATENT DOCUMENTS

| | | | | |
|---|---|---|---|---|
| 3,918,983 A | | 11/1975 | Papalos | |
| 3,948,790 A | * | 4/1976 | Speakman | 510/330 |
| 4,062,647 A | | 12/1977 | Storm et al. | |
| 4,287,086 A | | 9/1981 | Finlayson et al. | |
| 4,292,035 A | | 9/1981 | Battrell | |
| 4,431,673 A | * | 2/1984 | Goldner et al. | 514/770 |
| 4,747,419 A | * | 5/1988 | Flynn et al. | 132/73 |
| 4,844,821 A | * | 7/1989 | Mermelstein et al. | 510/328 |
| 4,999,125 A | * | 3/1991 | Goodman | 510/530 |
| 5,336,647 A | | 8/1994 | Nae et al. | |
| 5,429,999 A | | 7/1995 | Nae et al. | |
| 5,443,750 A | | 8/1995 | Convents et al. | |
| 5,576,257 A | * | 11/1996 | Jordan | 502/62 |
| 5,891,449 A | * | 4/1999 | Daniel et al. | 424/401 |
| 6,103,687 A | * | 8/2000 | Cody et al. | 510/504 |
| 6,376,438 B1 | * | 4/2002 | Rosenberger et al. | 510/139 |

FOREIGN PATENT DOCUMENTS

| | | |
|---|---|---|
| EP | 0 726 246 A1 | 8/1996 |
| GB | 1 580 456 | 3/1980 |
| WO | 99/24548 | 5/1999 |
| WO | 00/24857 | 4/2000 |

OTHER PUBLICATIONS

European Search Report / Application No. EP 00 31 1621 dated May 23, 2001, 2 pp.
International Search Report No. PCT/EP 01/14770 dated Apr. 18, 2002, 4 pp.
Database WPI Derwent Publications Ltd. XP–002168093 abstract of JP 09 095693 A.

* cited by examiner

*Primary Examiner*—Charles Boyer
(74) *Attorney, Agent, or Firm*—Alan A. Bornstein

(57) ABSTRACT

A fabric care composition comprises (i) an organophilic clay;

(ii) a functionalized oil; and (iii) water.

The composition may be used to provide fabrics with softness and/or anti-wrinkle and/or other fabric benefits in laundering processes.

15 Claims, No Drawings

FABRIC CARE COMPOSITIONS COMPRISING AN ORGANOPHILIC CLAY AND A FUNCTIONALIZED OIL

This is a continuation of Ser. No. 10/025,293 filed Dec. 19, 2001 now U.S. Pat. No. 6,656,901.

TECHNICAL FIELD

This invention relates to fabric care compositions, to the use of the compositions in fabric treatment and to a method of treating fabric with the compositions.

BACKGROUND AND PRIOR ART

The sensory feel of a fabric following conventional laundering processes is an important property. In particular, the "softness" of a fabric is a highly desirable quality in the laundered fabric. The term "softness" generally refers, for example, to the feeling of smoothness to the touch and flexibility of the fabric. In addition, the term "softness" refers to the general feeling of comfort registered by the human skin on contact with the fabric. The term "softness" is particularly considered to mean a lack of sensory negatives such as fabric stiffness and abrasiveness.

In addition to conferring softness benefits, it is also advantageous to reduce the extent of wrinkling, or creasing, of a fabric following laundering processes. The use of anti-wrinkle agents helps to reduce the need for ironing and thus saves on both the time and energy required for the laundering process.

A considerable number of additives have been developed for incorporation in or addition to, for example, the main wash cycles or tumble drying sequence of fabric laundering processes or industrial textile treatment processes in order to impart "softness" benefits. Treatments have also been proposed for imparting anti-wrinkle benefits to fabric.

Thus, it is well known in the art that some clay materials may be used to impart softening and antistatic properties when deposited on fabrics. Such clay deposition is generally achieved by contacting fabrics with high concentrations of an aqueous suspension of the clay under closely controlled conditions during commercial manufacturing and treatment processes.

U.S. Pat. No. 4,062,647 discloses a detergent composition comprising specified amounts of water soluble non-soap synthetic detergent, an inorganic or organic detergent builder salt and a smectite clay with specified cation exchange characteristics. The clay is not pre-treated with any organic compound prior to inclusion in the formulation. According to U.S. Pat. No. 4,062,647, these compositions provide fabric softening and/or anti-static benefits.

In order to provide the improved softening benefits claimed therein, U.S. Pat. No. 5,443,750 discloses detergent compositions comprising a specified cellulase and a softening clay such as, for example, a heat treated kaolin or various multi-layer smectites. The softening clays disclosed in this document have not been pretreated with organic compounds. According to U.S. Pat. No. 5,433,750, the combination of specified cellulase and clay leads to a synergistic improvement in softness benefits. Preferably, the compositions also comprise a flocculating agent. Liquid detergents further comprise an antisettling agent such as, for example, an organophilic clay (eg Bentone®).

It is also known in the art that organic compounds containing a cation will react with certain clays under favourable conditions to form organophilic organo-clay products. Furthermore, certain organophilic clays can be used in the gelling or thickening of certain organic liquids, depending upon the substituents of the organic cation.

An organophilic clay gellant is described in U.S. Pat. No. 4,287,086 in a method that claims to increase the viscosity of liquid organic systems. The organophilic clay disclosed in U.S. Pat. No. 4,287,086 is the reaction product of a particular smectite clay in a specified ratio with a methyl benzyl dialkyl ammonium salt. The resulting gels are stated as being useful as lubricating greases, oil base muds, paints and binders.

The preparation of organophilic clays is also disclosed in U.S. Pat. Nos. 5,336,647 and 5,429,999. In U.S. Pat. No. 5,336,647, organophillic clay gellants are described which comprise the reaction product of specified amounts of: (a) a smectite-type clay; (b) a specified first organic cation; and (c) a specified second organic cation. According to U.S. Pat. No. 5,336,647, such organophilic gellants provide improved gelling properties in organic solvents. U.S. Pat. No. 5,429,999 also discloses an organophilic gellant composition for use in non-aqueous systems, further comprising one or more specified organic anions that are capable of reacting with the first and/or second organic cations in the composition of U.S. Pat. No. 5,336,647 to form a complex with the smectite clay.

Further organophilic clay gellants are disclosed in EP-A-0726246. These clays comprise a specified ratio of certain quaternary ammonium ions and a specified diluent such as, for example, soya bean oil or oleic acid. According to EP-A-0726246, the organophilic clays are useful as rheological additives in both non-aqueous and aqueous systems such as, for example, inks, paints and varnishes.

The use of organoclays as gelling agents is also disclosed in WO 99/24548. According to this document, a gelling additive, which may comprise a specified selection of gelling agents, is added to a non-aqueous solvent in a specified ratio, to complete the thickening system in the gelatinous portion of a detergent tablet comprising at least one detergent active.

According to U.S. Pat. No. 3,948,790, detergent compositions comprising specified detergents and certain organophilic clays impart a softer feel to cotton terry towelling washed therein than compositions comprising the unmodified clay. The organophilic clays disclosed in U.S. Pat. No. 3,948,790 are prepared from an impalpable (ie, fine-grained) smectite clay having an ion-exchange capacity of at least 50 meq/100 g; from about 5 to 100 molar percent of the exchangeable cations comprising the clay are replaced with specified alkyl-substituted ammonium ions.

U.S. Pat. No. 4,292,035 discloses a fabric softening composition in solid form comprising:

(a) from about 10% to about 80% by weight of an impalpable smectite clay having an ion exchange capacity of at least 50 meq/100 grams;

(b) from about 1% to about 50% by weight of said clay of a compound selected from the group consisting of organic primary, secondary, and tertiary amines and their water soluble or water dispersible salts and organic quaternary ammonium, phosphonium and sulfonium compounds wherein said compounds have at least one hydrocarbon group having from 8 to 22 carbon atoms; and (c) an anionic surfactant present in the amount of at least 30% molar equivalence to component (b);

wherein components (a) and (b) are combined to form a complex prior to the addition of the anionic surfactant.

U.S. Pat. No. 3,918,983 describes a textile treatment comprising particular sulfated castor oil substitutes and the use of these sulfated derivatives as textile softeners when applied as finishes. The sulfated castor oil substitutes disclosed comprise specified amounts of at least one sulfated aliphatic alcohol, having from about 4 to about 30 carbon atoms, in conjunction with specified amounts of at least one sulfated unsaturated oil, other than castor oil.

WO 00/24857 discloses a laundry detergent product comprising a wrinkle reducing agent selected from one or more of a specified range of compounds, including sulfated and sulfonated vegetable oils.

It remains desirable to have improved systems for treating fabric that provide fabric softness and/or anti-wrinkle benefits.

The present invention aims to provide a fabric care composition affording softness benefits to fabric treated with the composition. The present invention also aims to provide a fabric care composition affording anti-wrinkle benefits to fabric treated with the composition. The compositions of the invention may provide one or more other advantages in fabric treated with the compositions, the advantages including one or more of: ease of ironing, better shape, body, improved texture, improved colour (including surface colour definition), better antistatic properties, reduced friction, better comfort in wear, increased water absorption and better durability (ie, resistance to wear). In a particularly preferred embodiment, the compositions of the invention are used for reducing the extent of creasing of fabric, such as before and/or during and/or after laundering.

Statement of Invention

According to the present invention, there is provided a fabric treatment composition comprising:

(i) an organophilic clay;

(ii) a functionalised oil; and (iii) water.

In another aspect of the invention, there is provided the use of the compositions of the invention to provide softness benefits for fabric.

In yet another aspect of the invention, there is provided the use of the compositions of the invention to provide anti-wrinkle benefits for fabric.

In a further aspect of the invention, there is provided a method of treating fabric, comprising applying to fabric a composition of the invention.

DETAILED DESCRIPTION OF THE INVENTION

It has been found that fabric care compositions comprising an organophilic clay, a functionalised oil and water impart unexpected softness benefits to fabrics treated with such compositions. The compositions can also impart anti-wrinkle benefits to fabrics treated with the compositions.

The fabric care composition typically comprises the organophilic clay in an amount of from 0.001% to 10% by weight of the composition. More preferably the organophilic clay is present in an amount of from 0.01% to 5% by weight of the composition. Advantageously, the clay is present in an amount of from 0.1% to 1% by weight of the composition.

The organophilic clay may be a single organophilic clay or a mixture of different organophilic clays.

The organophilic clay typically comprises material classified as smectite-type. Suitable smectite-type clays can preferably be described as impalpable, expandable, three-layer clays such as, for example, aluminosilicates and magnesium silicates having an cation exchange capacity of at least 50 milliequivalents per 100 grams of clay. The smectite-type clay preferably has a cationic exchange capacity of at least 75 milliequivalents per 100 g of clay, as determined by the well-known ammonium acetate method.

The term "impalpable", as used to describe the clays employed herein means that the individual clay particles are of such a size that they cannot be perceived tactilely. Such particle sizes are in general below 100 microns in diameter. Preferably, however, the clays will have a particle size (ie, a maximum dimension) within the range of from 0.01 to 50 microns.

The term "expandable" as used to describe the clays relates to the ability of the layered clay structure to be swollen, or expanded, on contact with water.

Smectite-type clays are well known in the art and are commercially available from a number of sources. In addition, suitable smectite-type clays may be sythesised by a pneumatolytic or hydrothermal process, such as, for example, disclosed in U.S. Pat. No. 3,252,757.

The smectite-type clay is preferably selected from the group consisting of: montmorillonite, bentonite, beidellite, hectorite, saponite, stevensite, and mixtures thereof. Where appropriate, the clays will have been subjected to the application of shear. The smectite-type clays may be sheared by processes well known to those in the art, such as disclosed in U.S. Pat. No. 4,695,402, for example.

More preferably the smectite-type clay is selected from bentonite and hectorite or mixtures thereof.

The organophilic clay typically comprises a first organic cation that is capable of forming an organoclay by exchange of the first organic cation with the cations of a smectite-type clay or mixture of smectite-type clays. Thus, the organic cation has a positive charge localised on a single atom or small group of atoms within the compound. Preferably, the first organic cation is selected from the group consisting of: quaternary ammonium salts, phosphonium salts, sulfonium salts and mixtures thereof.

The first organic cation is preferably selected from the group consisting of at least one of formula (I) and/or formula (II ):

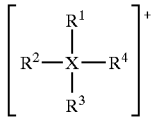

(I)

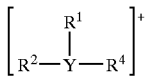

(II)

wherein X is nitrogen or phosphorus, Y is sulfur, $R^1$ is a linear or branched, saturated or unsaturated alkyl group having 12 to 22 carbon atoms and $R^2$, $R^3$ and $R^4$ are independently selected from the group consisting of: (a) linear or branched alkyl groups having 1 to 22 carbon atoms; (b) aralkyl groups which include benzyl and substituted benzyl moieties including fused ring moieties having linear chains or branches of 1 to 22 carbon atoms in the alkyl portion of the structure; (c) aryl groups such as phenyl and substituted phenyl including fused ring aromatic substituents; (d) beta, gamma-unsaturated groups having six or less carbon atoms or hydroxyalkyl groups having 2 to 6 carbon atoms; and (e) hydrogen.

The long chain alkyl radicals are preferably derived from naturally occurring oils including various vegetable oils, such as corn oil, coconut oil, soybean oil, cotton-seed oil, castor oil linseed oil, sunflower oil, palm oil, peanut oil and mixtures thereof and the like, as well as various animal oils such as, for example, tallow oil. The alkyl radicals may likewise be derived from petrochemical products such as, for example, alpha olefins.

Preferably, the organophilic clay comprises smectite clay, which has had from 5 to 100 molar percent of the exchangeable cations replaced by a quaternary ammonium group.

Representative examples of useful branched, saturated radicals include 12-methylstearyl and 12-ethylstearyl. Representative examples of branched unsaturated radicals include 12-methyloleyl and 12-ethyloleyl. Representative examples of unbranched saturated radicals include: lauryl; stearyl; tridecyl; myristyl (tetradecyl); pentadecyl; hexadecyl; hydrogenated tallow and docosanyl. Representative examples of unbranched, unsaturated and unsubstituted radicals include oleyl, linoleyl, linolenyl, soya and tallow.

Additional examples of aralkyl, that is benzyl and substituted benzyl moieties, include those materials derived from, eg., benzyl halides, benzyhdryl halides, trityl halides, alpha-halo-alpha-phenylalkanes wherein the alkyl chain has from 1 to 22 carbon atoms, such as 1-halo-1-phenylethane, 1-halo-1-phenylpropane, and 1-halo-phenyloctadecane; substituted benzyl moieties, such as those derived from ortho-, meta- and para-chlorobenzyl halides, para-methoxybenzyl halides, ortho-, meta- and para-nitrilobenzyl halides, and ortho-, meta- and para-alkylbenzyl halides wherein the alkyl chain contains from 1 to 22 carbon atoms; and fused ring benzyl-type moieties, such as those derived from 2-halomethylnaphthalene, 9-halomethylanthracene and 9-halomethylphenanthrene, wherein the halo group comprises chloro, bromo, iodo, or any other such group which serves as a leaving group in the nucleophilic attack of the benzyl type moiety such that the nucleophile replaces the leaving group on the benzyl type moiety.

Examples of aryl groups that are useful in the first organic cation include phenyl and substituted phenyl, N-alkyl and N,N-dialkyl anilines, wherein the alkyl groups contain between 1 and 22 carbon atoms; ortho-, meta- and para-nitrophenyl, ortho-, meta- and para-alkyl phenyl, wherein the alkyl group contains between 1 and 22 carbon atoms, 2-, 3-, and 4-halophenyl wherein the halo group is defined as chloro, bromo or iodo, and 2-, 3-, and 4-carboxyphenyl and esters thereof, where the alcohol of the ester is derived from an alkyl alcohol, wherein the alkyl group contains between 1 and 22 carbon atoms, aryl such as phenol, or aralkyl such as benzyl alcohols; fused ring aryl moieties such as naphthalene, anthracene and phenanthrene.

The beta, gamma unsaturated alkyl group which may be included in the first organic cation component of the organophilic clay gellants of the invention may be selected from a wide range of materials well known in the art. These compounds may be cyclic or acyclic, unsubstituted or substituted with aliphatic radicals containing up to 3 carbon atoms such that the total number of aliphatic carbons on the beta, gamma unsaturated radical is 6 or less. The beta, gamma unsaturated alkyl radical may be substituted with an aromatic ring that likewise is conjugated with the unsaturation of the beta, gamma moiety or the beta, gamma radical may be substituted with both aliphatic radical and aromatic rings.

Representative examples of cyclic beta, gamma-unsaturated alkyl groups include 2-cyclohexenyl and 2-cyclopentenyl. Representative examples of acyclic beta, gamma unsaturated alkyl groups containing 6 or less carbon atoms include propargyl; allyl(2-propenyl); crotyl(2-butenyl); 2-pentenyl; 2-hexenyl; 3-methyl-2-butenyl; 3-methyl-2-pentenyl; 2,3-dimethyl-2-butenyl; 1,1-dimethyl-2-propenyl; 1,2-dimethyl propenyl; 2,4-pentadienyl; and 2,4-hexadienyl. Representative examples of acyclic-aromatic substituted compounds include cinnamyl (3-phenyl-2 propenyl): 2-phenyl-2-propenyl; and 3-(4-methoxyphenyl)-2-propenyl. Representative examples of aromatic and aliphatic substituted materials include 3-phenyl-2-cyclohexenyl; 3-phenyl-2-cyclopentenyl; 1,1-dimethyl-3-phenylpropenyl; 1,1,2-trimethyl-3-phenyl-2-propenyl; 2,3-dimethyl-3-phenyl-2-propenyl; 3,3-dimethyl-2-phenyl-2-propenyl; and 3-phenyl-2-butenyl.

The hydroxyalkyl group may be selected from a hydroxyl substituted aliphatic radical wherein the hydroxyl is not substituted at the carbon atom adjacent to the positively charged atom; the group has from 2 to 6 aliphatic carbon atoms. The alkyl group may be substituted with an aromatic ring independently from the 2 to 6 aliphatic carbons. Representative examples include 2-hydroxyethyl; 3-hydroxypropyl; 4-hydroxypentyl; 6-hydroxyhexyl; 2-hydroxypropyl; 2-hydroxybutyl; 2-hydroxypentyl; 2-hydroxyhexyl; 2-hydroxycyclohexyl; 3-hydroxycyclohexyl; 4-hydroxycyclohexyl; 2-hydroxycyclopentyl; 3-hydroxycyclopentyl; 2-methyl-2-hydroxypropyl; 1,1,2-trimethyl-2-hydroxypropyl; 2-phenyl-2-hydroxyethyl; 3-methyl-2-hydroxybutyl; and 5-hydroxy-2-pentenyl.

The counteranion of the first organic cation in the starting material used for producing the organophilic clay is selected such that it will not adversely affect the reaction product or its recovery. Such anions include, for example, chloride, bromide, iodide, hydroxyl, nitrate and acetate. These are used in amounts sufficient to neutralise the organic cation.

The organophilic clay preferably comprises the first organic cation in an amount of from 75% to 150% of the cation exchange capacity of the smectite clay.

The preparation of the first organic salt can be achieved using methods well known in the art.

Preferably, the organophilic clay comprises, in addition to or separate from the first organic cation, a second organic cation which is a polyalkoxylated quaternary ammonium salt ie, a quaternary ammonium salt having alkoxy moieties.

The organophilic clay preferably comprises the second organic cation in an amount of from 0.01% to 20% by weight of the total organic cation content of the organophilic clay.

The second organic cation comprising a polyalkoxylated quaternary ammonium salt preferably comprises at least one linear or branched alkoxylated group containing at least two carbon atoms and one oxygen atom.

More preferably, the second organic cation is a hydrophilic agent having the general formula (III):

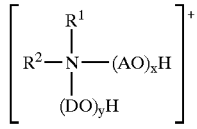

(III)

wherein $R_1$ and $R_2$ are independently selected from the group consisting of: (a) linear or branched alkyl groups having 1 to 22 carbon atoms; (b) aralkyl groups which include benzyl and substituted benzyl moieties including fused ring moieties, having linear chains or branches of 1 to 22 carbon atoms in the alkyl portion of the structure; (c) aryl groups such as phenyl and substituted phenyl including fused ring aromatic substituents; (d) beta, gamma-unsaturated groups having six or less carbon atoms; and (e) hydroxyalkyl groups having 2 to 6 carbon atoms; x and y represent the number of repeating alkyl oxide groups and are integers and the total x+y may be 1 to 200, preferably 2 to 200. The alkyl oxide (AO, DO) groups may include independently, two to eight carbon atoms such as, for example, ethyl, propyl, butyl and pentyl.

The salt anion present with the second organic cation in the starting material used for producing the organophilic clay may be selected from the group consisting of halogen anions, preferably chloride and bromide, hydroxide, acetate, nitrite, nitrate and the like and mixtures thereof. These anions are required to have such charge that they neutralize the alkoxylated quaternary ammomium salt.

Illustrative examples of suitable alkoxylated quaternary ammonium compounds include those available under the tradename Ethoquad from Akzo Chemie America, namely, methyl bis(2-hydroxyethyl)-cocoalkyl ammonium chloride, methyl bis(polyoxyethylene(15)) cocoalkyl quaternary ammonium chloride, methyl bis(2-hydroxyethyl) oleyl ammonium chloride, methyl bis(polyoxyethylene (15)) oleyl quaternary ammonium chloride, methyl bis(2-hydroxyethyl) octadecyl ammonium chloride, and methyl bis(polyoxyethylene (15)) octadecyl quaternary ammonium chloride.

The organophilic clay may also comprise one or more organic anions. The one or more organic anions are preferably capable of reacting, when present, with the first and/or second cation to form a complex with the smectite clay. Desirably the one or more anions has a molecular weight of less than 3,000 and contains at least one anionic moiety per molecule. In a more preferred embodiment, the molecular weight is 1,000 or less.

Preferably, the organic anion is selected from the group consisting of: anions formed from stearic acid, oleic acid, palmitic acid, succinic acid, tartaric acid; sulfonic acids; and alkyl sulfates.

The one or more organic anions may be added to the reaction mixture, to form the organophilic clay gellant, in acid or salt form. Examples of suitable salts include alkali metal salts, alkaline earth salts, ammonium and organic amines.

The amount of organic anion reacted with the smectite clay must be sufficient to obtain a milliequivalent ratio of organic cations to organic anion in the range of from 1.70:1.0 to 50:1.0, preferably from 3.0 to 1.0 to 15:1.0.

Organic clays and processes for their preparation, which are suitable for the purposes of the present invention, are described in U.S. Pat. Nos. 5,429,999 and 5,336,647, which are incorporated herein by reference.

The organophilic clay may be obtained and used as a solid eg, as the clay in powder or other particulate form. Alternatively, however, the organophilic clay is obtained, and used, in the form of a gel, dispersion or suspension comprising the clay together with an oil.

The oil combined with the organophilic clay in the gel may be, for example, a vegetable oil selected from the group consisting of: corn oil, coconut oil, soybean oil, cotton-seed oil, castor oil, linseed oil, sunflower oil, palm oil, peanut oil, lanolin, sesame oil, olive oil, avocado oil, truffle oil, rapeseed oil, soyabean oil, maize oil and mixtures thereof. A preferred vegetable oil is castor oil.

Organophilic clays, in the form of a gel comprising an oil, which may be used in the present invention are commercially available under the trade names Bentone Gel CAOV™,Bentone Gel LOIV™ and Bentone SD2 from Rheox Inc.

Bentone Gel CAOV™ comprises castor oil, stearalkonium (C18) hectorite and propylene carbonate (approximate weight ratio, 87:10:3). Bentone Gel LOIV™ comprises lanolin oil, isopropyl palmitate (C15), stearalkonium (C18) hectorite and propylene carbonate (approximate weight ratio 65:22:10:3). Bentone SD2 is stearalkonium bentonite.

The organoclay may be accompanied by any compatible anions such as, for example, chloride, methyl sulfate, bromide, formate, nitrate and sulfate but the nature of the anion is not crucial to the invention.

The compositions of the invention comprise a functionalised oil. The functionalised oil may be a single functionalised oil or a mixture of different functionalised oils. The term "functionalised" includes the presence of any functional group, structural unit or units capable of being attached by any chemical means to an oil, or otherwise incorporated within an oil, such that the functional group enables the functionalised oil to have increased solubility in an aqueous environment.

Preferably, the functionalised oil is present in an amount of from 0.01% to 50% by weight of the composition, more preferably, the amount of functionalised oil is from 0.1% to 30% by weight of the composition. In an especially preferred embodiment of the invention, the amount of functionalised oil is from 0.1% to 10% by weight of the composition.

Furthermore, in a particularly preferred embodiment of the invention the weight ratio of (i): (ii) (ie, organophilic clay: functionalised oil) varies from 10:1 to 1:10, more preferably from 5:1 to 1:5, even more preferably from 2:1 to 1:2.

The functionalised group will preferably comprise one or more polar functional groups. The polar functional group may or may not bear a formal positive or negative charge. If formally charged, however, the functional group will be associated with a counterion chosen so as not to interfere with the functionalised oil. Suitable counterions may, for example, be chosen from the group consisting of: alkali and alkaline earth metals, ammonium and organic ammonium salts, chloride, bromide, hydroxyl, acetate, nitrate, and mixtures thereof.

The functional group or structural unit preferably comprises one or more of the following polar groups: anionic groups such as, for example, sulfate, sulfonate, phosphate, phosphonate, carboxylate, carbonate, ethoxylate, hydroxyl, nitrate and nitrite; cationic groups such as, for example, $—NH_3^+$, or $—NR_3^+$, where R is an alkyl group containing 1 to 6 carbon atoms, or mixtures thereof. The functional group may be attached or otherwise included in the oil according to any of the methods well known in the art.

Typically, the functionalised oil comprises a functionalised vegetable oil, in which the vegetable oil is preferably selected from the group consisting of: corn oil, coconut oil, soybean oil, cotton-seed oil, castor oil, linseed oil, sunflower oil, palm oil, peanut oil, lanolin, sesame oil, olive oil, avocado oil, truffle oil, rapeseed oil, soyabean oil, maize oil and mixtures thereof.

Preferably, the functionalised oil is a sulfated vegetable oil; more preferably, the functionalised oil is sulfated castor oil.

Methods of synthesising sulfated castor oil from natural materials are well known to those skilled in the art. However, suitable sulfated castor oil may also be obtained commercially from Goodrich under the trademark Freedom SCO-75.

The compositions of the invention preferably comprise a textile compatible carrier. The nature of the textile compatible carrier will be dictated to a large extent by the stage at which the composition of the invention is used in a laundering process, the compositions being capable of being used, in principle, at any stage of the process. For example, where the compositions are for use as main wash detergent compositions, the one or more textile compatible carriers comprise a detergent active compound. Where the compositions are for use in the rinsing step of a laundering process, the one or more textile compatible carriers may comprise a fabric softening and/or conditioning compound.

The compositions of the invention preferably comprise a perfume, such as of the type which is conventionally used in fabric care compositions. The compositions may be packaged and labelled for use in a domestic laundering process.

In the context of the present invention the term "textile compatible carrier" is a component which can assist in the interaction of the first component with the fabric. The carrier can also provide benefits in addition to those provided by the first component e.g. softening, cleaning etc.

If the composition of the invention is to be used in a laundry process as part of a conventional fabric treatment product, such as a detergent composition, the textile-compatible carrier will typically be a detergent-active compound. Whereas, if the fabric treatment product is a rinse conditioner, the textile-compatible carrier will be a fabric softening and/or conditioning compound.

If the composition of the invention is to be used before, or after, the laundry process it may be in the form of a spray or foaming product.

The fabrics, which may be treated in the present invention, include those which comprise cellulosic fibres, preferably from 1% to 100% cellulosic fibres (more preferably 5% to 100% cellulosic fibres, most preferably 40% to 100%). The fabric may be in the form of a garment, in which case the method of the invention may represent a method of laundering a garment. When the fabric contains less than 100% cellulosic fibres, the balance comprises other fibres or blends of fibres suitable for use in garments such as polyester, for example. Preferably, the cellulosic fibres are of cotton or regenerated cellulose such as viscose.

The laundering processes of the present invention include the large scale and small scale (eg domestic) cleaning of fabrics. Preferably, the processes are domestic.

In the invention, the composition of the invention may be used at any stage of the laundering process. Preferably, the composition is used to treat the fabric in the rinse cycle of a laundering process. The rinse cycle preferably follows the treatment of the fabric with a detergent composition.

The compositions of the invention comprise water, preferably in an amount of from 0.01% to 90% by weight, more preferably from 1% to 75% by weight.

Detergent Active Compounds

If the composition of the present invention is in the form of a detergent composition, the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5\ M_2O.Al_2O_3.0.8\text{–}6SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Fabric Softening and/or Conditioner Compounds

If the composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

(II)

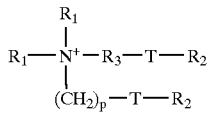

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein $R_3$ is a linear or branched alkylene group of 1 to 5 carbon atoms, T is

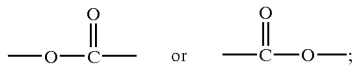

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

(III)

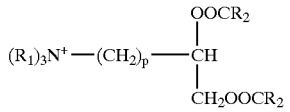

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain the polyol polyester (eg, sucrose polyester) compounds described in WO 98/16538.

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further Optional Ingredients

Further optional ingredients in the compositions of the invention include non-aqueous solvents, perfume carriers, fluorescers, colourants, hydrotropes, antifoaming agents, antiredeposition agents, enzymes, optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents, ironing aids, bleach systems and soil release agents. This list is not intended to be exhaustive.

The compositions of the invention may also include an agent, which produces a pearlescent appearance, e.g. an organic pearlising compound such as ethylene glycol distearate, or inorganic pearlising pigments such as microfine mica or titanium dioxide ($TiO_2$) coated mica.

An anti-settling agent may be included in the compositions of the invention. The anti-settling agent, which reduces the tendency of solid particles to separate out from the remainder of a liquid composition, is preferably used in an amount of from 0.5 to 5% by weight of the composition. Organophilic quaternised ammonium-clay compounds and fumed silicas are examples of suitable anti-settling agents.

A further optional ingredient in the compositions of the invention is a flocculating agent which may act as a delivery aid to enhance deposition of the active ingredients (such as the water insoluble particles) onto fabric. Flocculating agents may be present in the compositions of the invention in amounts of up to 10% by weight, based on the weight of the organoclay. Suitable flocculating agents include polymers, for example long chain polymers and copolymers comprising repeating units derived from monomers such as ethylene oxide, acrylamide, acrylic acid, dimethylaminoethyl methacrylate, vinyl alcohol, vinyl pyrrolidone, ethylene imine and mixtures thereof. Gums such as guar gum, optionally modified, are also suitable for use as flocculating agents.

Other possible delivery aids for the water insoluble particles include, for example, the water-soluble or water-dispersible rebuild agents (eg, cellulose monoacetate) described in WO 00/18860.

The invention will now be described by way of example only and with reference to the following non-limiting examples. In the examples and throughout this specification all percentages are percentages by weight unless indicated otherwise.

EXAMPLES

Examples 1 to 3

Softness Assessment

All measurements were carried out on treated woven cotton swatches and an average hysteresis at 5-degree angle (HG5) value calculated for measurements carried out on 6 cloths treated identically. The compositions of the following examples were padded onto the woven cotton fabric as aqueous solutions/dispersions. The balance of the compositions was water. The shear hysteresis measurements were carried out on the treated fabric, after drying. Softness assessment is carried out using a laboratory softness measurement device, the Kawabata KES-FB1 machine, Kato Tech Corporation Ltd, Japan as described in U.S. Pat. No. 5,443,750. In this machine the softness tracers are laced between two clamps which are moveable relative to each other. Comparative softness was measured by shear hysteresis at 5-degree angle (2HG5). A decrease in shear hysteresis reflects increased softness.

Crease Recovery Angle

The method described here to monitor the ability of a fabric to recover from an induced crease is used within the textile industry. Before any treatment was applied the warp direction on the fabric to be used was marked. Having done this, the fabric was treated with the compositions of the following examples under pressure. Excess dispersion was removed. The fabric was tumble dried and ironed flat. The ironed fabric was left to condition at 65% relative humidity (r.h.) and 20° C. for 24 hours prior to testing.

The fabric was then ready for testing. All testing was done in a test room at 65% r.h. and 20° C. using tweezers to handle the fabrics at all times, in order to prevent extraneous grease from affecting the results. Six rectangular samples, each with an area of 50 mm by 25 mm, were cut from the treated fabric, using a template, and cut such that the long edge was parallel to the warp direction. The sample was then folded in half crossways, so that each sample was a square with an area of 25 mm square.

The sample was then placed on the lower plate of a loading device such that the crease was under the weight and the ends were in line with the edge of the lower plate. The weight was then lowered down gently. After leaving for one minute, the weight was removed and the sample transferred to from the loading device to a tester (protractor) using a pair of tweezers. The fabric was positioned and fixed such that one end touched the back-stop and the free end hung vertically. After leaving the fabric in a vertical position for 1 minute, the crease recovery angle (CRA) was measured by taking a reading from the circular scale at the index line.

TABLE 1

Improvement of crease recovery angle and shear of fabric treated using organoclay + castor oil + sulfated castor oil.

| Example | Sample - % on weight of fabric | Crease Recovery Angle (°) | Shear (Hysteresis at 5°) |
|---|---|---|---|
| Comparative Example A | Untreated ($H_2O$) | 77 | 5.4 |
| 1 | 0.125% A + 0.125% B | 81 | 4.6 |
| Comparative Example B | 0.25% A | 79 | 5.4 |
| 2 | 0.25% A + 0.25% B | 81 | 4.6 |
| Comparative Example C | 0.5% A | 83 | 4.8 |
| 3 | 0.5% A + 0.5% B | 82 | 4.5 |
| Comparative Example D | 1% A | 78 | 4.9 |

A = sulfated castor oil
B = organo-exchanged clay/castor oil gel (10%/90% on weight of composition)

Examples 4 to 11

Example 4

The following is an example of a main wash detergent composition according to the invention.

| | Weight % |
|---|---|
| Na-LAS | 6 |
| Nonionics | 7 |
| Na-silicate | 5 |
| Na tripolyphosphate | 23 |
| Na-sulphate | 10 |
| Na-carbonate | 8 |
| Bentone Gel CAOV | 5* |
| Sulphated castor oil | 5 |
| Water | 10 |
| Make up to 100% with additional additives, eg fluorescers, bleach systems, enzymes, perfume etc. | |

*as active organoclay, in both this example and for the Bentone products used in the subsequent examples

Example 5

The following is an example of a concentrated detergent composition according to the invention.

| | Weight % |
|---|---|
| Na-LAS | 10 |
| Nonionics 7EO + 3EO | 6 |
| Zeolite A4 | 35 |

-continued

| | Weight % |
|---|---|
| Soda ash | 7 |
| Bentone Gel CAOV | 5 |
| Sulphated castor oil | 5 |
| Water | 6 |
| Make up to 100% with minor additives | |

Example 6

The following is an example of a liquid detergent composition according to the invention.

| | Weight % |
|---|---|
| Na-LAS + nonionics | 20 |
| Na-citrate | 5 |
| Bentone Gel CAOV | 2 |
| Sulphated castor oil | 2 |
| Water | 6 |
| Other additives: water, perfume, enzymes | |

Example 7

The following is an example of a fabric conditioner composition according to the invention.

| | Weight % |
|---|---|
| HEQ* | 5 |
| Bentone Get LOIV | 3 |
| Sulphated castor oil | 3 |
| Coco alcohol 20EO | 0.2 |
| Natrasol** | 0.05 |
| Minor ingredients: perfume, stabilisers | <5 |
| Deionized water | QS to 100% |

*di(hardened tallowoyloxy) trimethylammonium propane chloride
**hydrophobically modified hydroxyethyl cellulose

Example 8

The following is another example of a rinse conditioner composition according to the invention.

| | Weight % |
|---|---|
| HEQ | 5 |
| Bentone Gel LOIV | 3 |
| Sulphated castor oil | 3 |
| Coco 20EO | 0.2 |
| Natrasol | 0.05 |
| Minor ingredients: perfume, stabilisers | <5 |
| Deionized water | QS to 100% |

Example 9

The following is another example of a rinse conditioner composition according to the invention.

| | Weight % |
|---|---|
| HEQ | 11 |
| Bentone Gel CAOV | 3 |
| Sulphated castor oil | 3 |
| Coco 20EO | 0.9 |
| Tallow fatty acid | 0.9 |
| Minor ingredients: perfume, stabilisers | <5 |
| Deionized water | QS to 100% |

Example 10

The following is another example of a rinse conditioner composition according to the invention.

| | Weight % |
|---|---|
| HEQ | 12 |
| Bentone Gel CAOV | 3 |
| Sulphated castor oil | 3 |
| Coco 20EO | 0.9 |
| Sucrose polyester | 4 |
| Minor ingredients: perfume, stabilisers | <5 |
| Deionized water | QS to 100% |

Example 11

The following is another example of a rinse conditioner composition according to the invention.

| | Weight % |
|---|---|
| Accosoft 460HC* | 10 |
| Bentone Gel LOIV | 3 |
| Sulphated castor oil | 3 |
| Arquad 2HT** | 9 |
| Minor ingredients: perfume, stabilisers, thinning agent | <5 |
| Deionized water | QS to 100% |

*fabric softener (ex Stepan)
**di(hardened tallow alkyl) dimethyl ammonium chloride Example 12

The following is an example of a main wash composition according to the invention.

| | |
|---|---|
| Na-LAS | 10% |
| Non-ionics 7EO + 3EO | 6% |
| Zeolite A4 | 35% |
| Soda Ash | 7% |
| Bentone SD2 | 3.5% |
| Sulphated castor oil | 6.5% |
| Water | 6% |
| Make up to 100% with minor additives | |

Example 13

The following is a further example of a main wash composition according to the invention.

| | |
|---|---|
| Na-LAS | 6% |
| Non-ionics | 7% |
| Na-silicate | 5% |
| Na tripolyphosphate | 23% |
| Na-sulphate | 8% |
| Na-carbonate | 5% |
| Bentone SD2 | 8% |
| Sulphated castor oil | 25% |
| Water | 10% |
| Make up to 100% with additional additives. | |

Example 13

The performance of organo-exchanged clay/sulfated castor oil systems under simulated wash conditions was tested using tergotometers. In all cases 1 litre of tap water was heated to 40° C. before addition of the wash treatment. Fabric swatches 8×(20×20 cm) [approx. 40 g], were added to the treatment baths and agitated for 30 minutes. Two 5 minute cold water rinses were subsequently carried out. Excess water was hydroextracted, and the fabric were line dried, ironed and conditioned at 20° C. 65% relative humidity before Kawabata shear measurements were made as described in Example 1.

Tests were conducted using the commercially available powder detergents Persil Performance, which contains sodium tripolyphosphate builder, and Omo, which contains a zeolite builder. The detergents were used alone and additioned with sulfated castor oil and the combination of Bentone SD2 and sulfated castor oil. The results are reported in the following table.

| | powder detergent | SCO level in formulation % | Bentone-SD2 level in formulation | Fabric type | Shear hysteresis 2HG5 score |
|---|---|---|---|---|---|
| comparative | Persil Performance | — | — | Resinated cotton poplin | 6.9 |
| comparative | Persil Performance | 25 | — | Resinated cotton poplin | 6.4 |
| invention | Persil Performance | 25 | 8 | Resinated cotton poplin | 6.1 |
| comparative | Omo | — | — | Unresinated cotton poplin | 6.8 |
| invention | Omo | 6.5 | 3.5 | Unresinated cotton poplin | 6.2 |

What is claimed is:

1. Fabric care composition comprising (i) an organophilic clay;

(ii) a functionalized oil;

(iii) water; and (iv) a compound selected from a cationic or nonionic fabric softening compound, fluorescers, antifoaming agents, antiredeposition agents, enzymes, optical brightening agents, dye transfer inhibitors, anti-shrinking agents, anti-spotting agents, chlorine scavengers, dye fixatives, anti-corrosion agents, drape imparting agents, antistatic agents, ironing aids, bleach systems, soil release agents, 10 to 70% by wt. of a detergency builder, or a blend thereof.

2. A fabric care composition according to claim 1 wherein said organophilic clay comprises a smectite-type clay.

3. A fabric care composition according to claim 2 wherein said smectite-type clay is a member selected from the group consisting of montmorillonite, bentonite, beidellite, hectorite, saponite, stevensite, and mixtures thereof.

4. A fabric care composition according to claim 2 wherein said organophilic clay comprises a first organic cation.

5. A fabric care composition according to claim 4 wherein said first organic cation is a member selected from the group consisting of quaternary ammonium salts, phosphonium salts, sulfonium salts and mixtures thereof.

6. A fabric care composition according claim 1 wherein the organophilic clay is included in the composition in the form of a gel comprising an oil.

7. A fabric care composition according to claim 6 wherein said oil comprises a vegetable oil which is a member selected from the group consisting of corn oil, coconut oil, soybean oil, cotton-seed oil, castor oil, linseed oil, safflower oil, palm oil, peanut oil, lanolin, sesame oil, olive oil, avocado oil, truffle oil, rapeseed oil, soyabean oil, maize oil and mixtures thereof.

8. A fabric care composition according to claim 1 wherein said organophilic clay is in particulate form.

9. A fabric care composition according to claim 1 wherein said functionalised oil comprises a functionalised vegetable oil in which the vegetable oil is a member selected from the group consisting of corn oil, coconut oil, soybean oil, cotton-seed oil, castor oil, linseed oil, sunflower oil, palm oil, peanut oil, lanolin, sesame oil, olive oil, avocado oil, truffle oil, rapeseed oil, soyabean oil, maize oil and functionalised mixtures thereof.

10. A fabric care composition according to claim 9 wherein said functionalised oil is a sulfated vegetable oil.

11. A fabric care composition according to claim 10 wherein said functionalised oil is sulfated castor oil.

12. A fabric care composition according to claim 1 wherein said organophilic clay is present in an amount of from 0.001% to 10% by weight of the composition.

13. A fabric care composition according to claim 9 wherein said functionalised oil is present in an amount of from 0.01% to 50% by weight of the composition.

14. A fabric care composition according to claim 1 wherein said weight ratio of (i): (ii) is in the range of from 10:1 to 1:10.

15. A method of treating fabric to provide softness benefits for fabric and/or to provide anti-wrinkle benefits for fabric comprising applying to a fabric a composition comprising (i) an organophilic clay;

(ii) a functionalised oil;

(iii) water; and (iv) a compound selected from a cationic or nonionic fabric softening compound, fluorescers, antifoaming agents, antiredeposition agents, enzymes, optical brightening agents, dye transfer inhibitors, anti-shrinking agents, anti-spotting agents, chlorine scavengers, dye fixatives, anti-corrosion agents, drape imparting agents, antistatic agents, ironing aids, bleach systems, soil release agents, 10 to 70% by wt. of a detergency builder, or a blend thereof.

* * * * *